US005127383A

United States Patent [19]

Wild

[11] Patent Number: 5,127,383

[45] Date of Patent: Jul. 7, 1992

[54] ADAPTIVE ACCELERATION ENRICHMENT FOR PETROL INJECTION SYSTEMS

[75] Inventor: Ernst Wild, Oberriexingen, Fed. Rep. of Germany

[73] Assignee: Robert Bosch GmbH, Stuttgart, Fed. Rep. of Germany

[21] Appl. No.: 689,855

[22] PCT Filed: Dec. 10, 1988

[86] PCT No.: PCT/EP88/01136

§ 371 Date: Jun. 7, 1991

§ 102(e) Date: Jun. 7, 1991

[87] PCT Pub. No.: WO90/06428

PCT Pub. Date: Jun. 14, 1990

[51] Int. Cl.[5] ..... F02M 51/00

[52] U.S. Cl. ..... 123/492; 123/672; 123/682

[58] Field of Search ..... 123/492, 489, 480, 440, 123/422, 399; 364/431.02

[56] References Cited

U.S. PATENT DOCUMENTS

| | | | |
|---|---|---|---|
| 3,971,354 | 7/1976 | Luchaco et al. | 123/425 |
| 4,187,812 | 2/1980 | Hosaka et al. | 123/425 |
| 4,245,312 | 1/1981 | deVulpillieres | 123/425 |
| 4,478,192 | 10/1984 | Kinoshita et al. | 123/425 |
| 4,586,478 | 5/1986 | Nogami et al. | 123/425 |
| 4,596,221 | 6/1986 | Ament et al. | 123/425 |
| 4,665,878 | 5/1987 | Takeuchi et al. | 123/425 |
| 4,682,577 | 7/1987 | Kato et al. | 123/425 |
| 4,787,357 | 11/1988 | Nishikawa et al. | 123/425 |
| 4,932,376 | 6/1990 | Linder et al. | 123/422 |
| 4,934,328 | 6/1990 | Ishii et al. | 123/492 |
| 4,936,278 | 6/1990 | Umeda | 123/489 |
| 4,953,530 | 9/1990 | Onagoka et al. | 123/399 |
| 4,964,051 | 10/1990 | Sekozawa et al. | 364/431.04 |
| 4,966,118 | 10/1990 | Itakura et al. | 123/492 |

FOREIGN PATENT DOCUMENTS

| | | |
|---|---|---|
| 0136519 | 8/1984 | European Pat. Off. . |
| 2554509 | 11/1983 | France . |
| 2030730A | 4/1980 | United Kingdom . |
| 2203266A | 10/1988 | United Kingdom . |

*Primary Examiner*—Raymond A. Nelli
*Attorney, Agent, or Firm*—Kenyon & Kenyon

[57] ABSTRACT

A petrol injection system for an internal combustion engine, the system being adapted to provide additional petrol into the inlet manifold of the engine during acceleration conditions in order to compensate for the less efficient transference of vaporized fuel to the engine cylinders during acceleration conditions, the quantity of additional fuel (BA) being determined in accordance with a stored enrichment value (FBAAM) which is adjusted regularly to take into account changing engine conditions. During the warming-up phase of the engine when the normal lambda regulation is inactive, the magnitude and direction of adjustment of the acceleration enrichment value (FBAAM) is derived from the behavior of the rotational speed (n) of the engine and the λ probe signal ($\lambda > 1$ or $\lambda < 1$) during an acceleration enrichment operation in that if, during an acceleration enrichment operation in the warming-up phase of the engine, it is detected that the λ probe output continues to indicate a rich mixture ($\lambda > 1$) and that there was an engine speed drop, it is concluded that the acceleration enrichment factor is too high and steps are taken to reduce it. However, if it is detected that the λ probe has changed to indicate a lean mixture and that there was an engine speed drop, it is concluded that the acceleration enrichment factor is too low and steps are taken to increase it.

5 Claims, 4 Drawing Sheets

ADAPTIVE ACCELERATION ENRICHMENT FOR PETROL INJECTION SYSTEMS

BACKGROUND OF THE INVENTION

The present invention relates to acceleration enrichment for petrol injection systems.

Petrol consists of chains of hydrocarbons of varying length. As temperature increases and pressure decreases, even the longer molecule chains vaporize.

during idling conditions in petrol injection systems, a vacuum is present in the inlet manifold downstream of the throttle valve. The injected petrol vaporize completely and passes into the cylinder. However, as the throttle valve is opened, the intake mainfold pressure increases correspondingly. The tendency of the fuel to vaporize then decreases, the result being that longer fuel molecule chains are deposited in liquid form as a film on the wall of the intake manifold. The latter quantity of fuel is not combusted and the mixture which is actually combusted is too lean. The acceptance of petrol is thus poor during acceleration conditions. It is the object of acceleration enrichment (BA) to provide an excess quantity of fuel during acceleration so that the engine receives the correct mixture composition during acceleration despite the formation of the film on the wall.

This excess quantity is determined during initial installation of new engines and is stored permanently in the data store of the control device of the fuel injection system.

It has recently been established, however, that coking of the inlet valves occurs following a longish operating time and dependent upon the type of petrol used and the driver's driving technique. This has a deleterious effect on acceleration, since the coking on the intake valve acts during acceleration as a sponge in addition to the film on the wall. Fuel drops are caught in the coked, porous surface of the intake valve and are not combusted. As a consequence of the resulting too-lean mixture, the engine torque drops considerably. In the worst cases, the engine can actually stop during an acceleration demand. If the acceleration enrichment quantity is increased considerably, normal driving is once again possible. However, this excess quantity cannot be provided for in a new engine, since it would not then be possible to adhere to legal exhaust-gas limitations. Also, the driving performance of new vehicles would be poorer, because over-enrichment would cause the engine torque to drop during acceleration. A method is therefore required which automatically adapts the excess acceleration quantity to engine conditions.

Some adaptive methods for acceleration enrichment are already known, e.g. as described in DE-OS 2 841 268 (GB-PS No. 20 30 730) and US-PS No. 4 245 312.

However, these known methods use only the information from a conventional lambda (air-fuel ratio $\lambda$) regulator for the adaptation. Conventional lambda regulators are, however, only activated at engine temperatures of above 20° C. Below this temperature, there is controlled driving only, because an engine requires a richer mixture than lambda = 1. In addition, there are no legal exhaust-gas regulations effective below this temperature. The only criterion in this range is the driving performance. Up till now, the only technique available has been to apply to cold engines adaption values established for a warm engine, without the accuracy thereof being tested.

It has now been determined using some actual examples of coked intake valves that the acceleration enrichment factor for a warm engine must be increased some five-fold with respect to the new state in order for lambda = 1 to be obtained again during acceleration enrichment. In the known methods, in the case of a cold engine (−30 degrees . . . +20 degrees), the acceleration enrichment, which has been considerably increased over that for a warm engine, is increased by a further factor of 0.5 during engine warm-up. There is thus a risk of over-enrichment.

It is an object of the present invention to provide a technique of adaptive acceleration enrichment which overcomes the above-discussed problems of the known solutions.

SUMMARY OF THE INVENTION

The present invention is a system and method for adaptive acceleration enrichment for fuel injected engines in situations when there is active and inactive lambda regulator control.

The system and method of the present invention are used during acceleration enrichment periods to ideally achieve lambda = 1 operation of the engine. This is accomplished by developing and applying acceleration enrichment whether the engine is warm or cold.

According to the method of the present invention, the fuel injection quantity t1 is determined for a given acceleration enrichment period. From this determination, the adaptive factor for acceleration enrichment is determined based on whether or not there is active or inactive lambda regulator control.

If there is active regulator control, the adaptive factor is based on the lambda regulator value Fr being compared with the average regulator value Frm (which is an average of Fr values from previous acceleration enrichment periods). The adaptive factor then cause adjustment of the fuel injected to compensate for the injected mixture being too rich or too lean during acceleration.

When there is inactive lambda regulator control, there are no Fr values available for use in determining the adaptive factor. So, a lambda probe is used along with the presence or absence or engine speed drops during the previous enrichment periods to provide a basis for determining the adaptive factor.

This has the advantage that adaptive acceleration enrichment can be maintained satisfactorily even during the warming-up phase of the engine.

BRIEF DESCRIPTION OF THE DRAWING

The invention is described further hereinafter, by way of example only, with reference to the accompanying drawings, in which.

DESCRIPTION OF EXEMPLARY EMBODIMENTS

Figure 1:
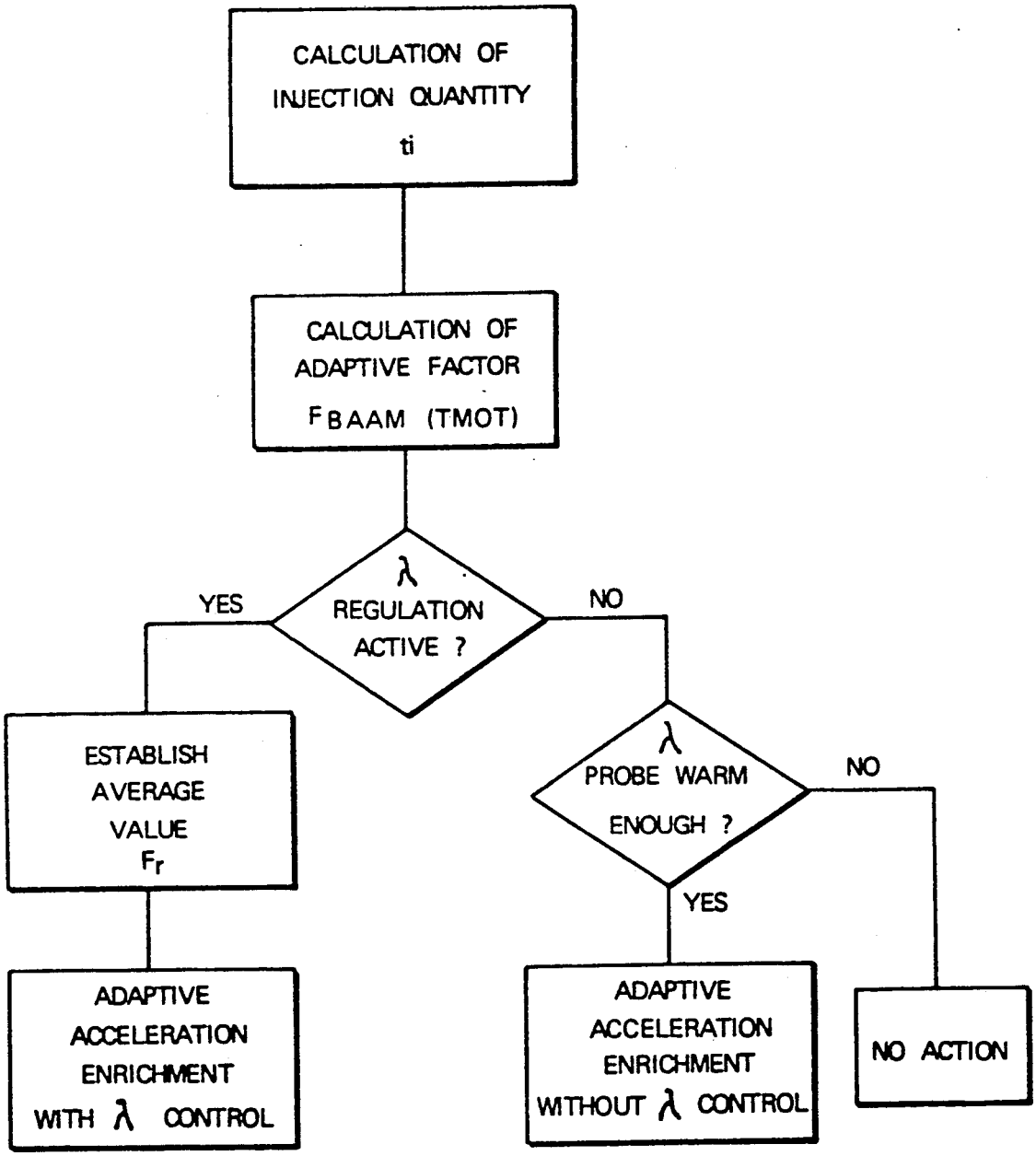
FIG. 1 is a flow diagram illustrating the overall operation of a system in accordance with the present invention.

When calculating the quantity of fuel to be injected during acceleration enrichment under normal operational (engine warm) conditions, an engine load single t1, which is proportional to the mass of intake air per stroke, is used to form a control time ti of an injection valve, in that the engine load signal is multiplied by other correction factors Fi and then added to a voltage correction time TVUB.

$$Ti = tL \times Fi + TVUB$$

The factors Fi include a factor Fr, by way of which the lambda regulator acts on the mixture, as well as an acceleration factor Fba. Thus:

$$Fi = Fr \times Fba(t) \times Fue,\ Fue = other\ factors,$$

which need not be considered for the present purposes.

At the moment at which acceleration enrichment is triggered, the acceleration factor Fba(t) is raised to an initial value Fba(O) and is subsequently linearly controlled downwards with the time constants DTBAM to the value 1. Thus:

$$FBA(t) = FBA(O) - DTBAM \times 1$$

The initial value FBA(O) is made up of the following:

$$FAB(O) = 1 + FBAQ \times FBAM \times KFBA \times FBAAM,$$

where

FBAQ—factor dependent on the gradient of the load signal

FBAM—factor dependent on engine temperature

KFBA—performance graph factor dependent on load and speed

FBAAM—adaptation characteristic dependent on engine temperature.

The characteristic curve for FBAAM consists of support points at which values are stored and between which linear interpolations are made.

e.g. FBAAM=f(TMOT), TMOT—engine temperature

There may, for example, be two support points:

Support point 1=a value FBAA1 associated with TMOT1

Support point 2=a value FBAA2 associated with TMOT2

The characteristic value of FBAAM for an engine temperature of between TMOT1 and TMOT2 is thus

FBAAM(TMOT)=FBAA1+(FBAA2−FBAA1)×(TMOT−TMOT1)/(TMOT2−TMOT1).

For active lambda control conditions, (i.e. when the engine is warmed up) the criterion for adaptation is obtained from the lambda regulator output.

However, the lambda signal arrives too late to correct an acceleration operation which is still running. This is conditioned by the time the exhaust gas takes to reach the lambda probe in the exhaust manifold and by the response delay of the probe itself.

The probe supplies only the statement:λmixture too rich (λ<1) or too lean λ>(1). Only at the instant at which the probe voltage changes (i.e. There is a voltage jump) is it known that the exhaust gas flowing past is at lambda=1.

The integrating behavior of the lambda regulator does, however, make it possible to conclude to what extent the mixture was incorrect on gas admission. The longer and more intensely the regulator has to enrich the mixture in a ramp-like manner following acceleration enrichment until the problem once again indicates a rich mixture, the leaner the mixture will be during acceleration.

Adaptive acceleration enrichment with active lambda regulation uses the following correlations:

An average value Frm is formed from the values at the control output Fr at the instants of probe jump.

When an acceleration enrichment operation is triggered, a time counter having the value TBA is started. Only when the counter has stopped is the next probe transient sought. In this way, it is ensured that no problem signal is used for evaluating the acceleration enrichment which belongs to the mixture prior to the acceleration enrichment.

The value of the lambda regulator output Fr at the instant of the probe jump is compared with the stored average value Frm obtained previously. The leaner the mixture during acceleration enrichment, the longer and further the lambda governor had to enrich the mixture in a ramp-like manner until the problem once again detected a mixture where lambda=1, If the difference between Fr and Frm lies above a threshold DFRP, then the above-described adaptive characteristic FBAAM, which is stored as a function over engine temperature is adjusted, and, for example, has two support points according to the following formula:

FBAA1(TMOT1)−new=FBAA1(TMOT1)-old+(FR-Frm)×ZBAA×(TMOT−TMOT1)/(TMOT2−TMOT1)

and

FBAA2(TMOT2)-new=FBAA2(TMOT2)-old+(Fr−FRm)×ZBAA×(TMOT2−TMOT)/(TMOT2−TMOT1)

The learning speed of the adaptation is adjusted by way of the value ZBAA.

If the difference is negative and exceeds another threshold DFRN, then the adaptation factor is reduced in accordance with the following formula:

FBAA1(TMOT1)-new=FBAA1(TMOT1)-old+(FR−Frm)×ZBAA×(TMOT−TMOT1)/(TMOT2−TMOT1)

and

FBAA2(TMOT2)-new=FBAA2(TMOT2)-old+(Fr−Frm)×ZBAA×(TMOT2−TMOT)/(TMOT2−TMOT1)

In this way, the adaptive correction factor is assigned to the associated engine temperature.

The adaptation factor FBAA influences a characteristic FBAAM in a non-volatile RAM, which is stored as a function of the engine temperature. The learned adaptation factor adjusts the values of the characteristic at the support points between which it is located, in accordance with the principle of inverse interpolation. The further the engine temperature support point of the characteristic value is from the actual temperature, the weaker the adjustment of said value.

Since there is no information available from the conventional lambda regulator when the engine is cold, two other criteria are used for adaptation.

Use is made of a recently available heated problem, which can be made warm enough to provide a usable signal [lambda > 1 (lean or lambda < 1 (rich)] within a short time, even when the engine itself is cold.

During the engine warm-up time such a lambda probe normally (not an acceleration condition), indicates the signal lambda < 1 (rich). If then, after a dead time TBA following acceleration enrichment being triggered there occurs with a time TSU a change in the probe output such that it indicates lambda < 1 (lean mixture) this means that the mixture became leaner during acceleration enrichment. It can then be concluded that the acceleration enrichment factor must be increased.

However, in this way it cannot be recognized whether there has been excess enrichment during an acceleration enrichment.

To recognize the excess enrichment, a further criterion is required. This criterion can be derived from the engine speed curve. If the speed drops rather than increases following triggering of an acceleration enrichment, then there was excess enrichment during the acceleration enrichment. In this case, the adaptation factor must be reduced.

A drop in speed is established by comparing the speed at the instant of acceleration enrichment triggering with the speeds within the time TBA. If the actual speed is below the speed at the moment of acceleration enrichment triggering, a speed drop flag is set in the control device.

In some cases, it may be necessary to form a more differentiated "speed drop" criterion. Instead of comparing it with the actual speed, it could be compared with the average value of the speeds, whereby this average value is recalculated following each acceleration enrichment triggering. As a result, fluctuations in speed caused by a tendency to jolt would not set the speed drop flag.

Thus, if the λ probe continues to show λ < 1 (rich) during acceleration enrichment and there is an engine speed drop, then it can be concluded that that acceleration enrichment was too great. The acceleration enrichment factor is then arranged to be reduced the next time that acceleration enrichment is provided.

On the other hand, if the λ probe changes to indicate a lean mixture (λ < 1) during acceleration enrichment and there is an engine speed drop, then it can be concluded that that acceleration enrichment was too weak. The acceleration enrichment factor is then arranged to be increased the next time that acceleration enrichment is provided.

The above-described operation is illustrated in the form of simplified flow diagrams in the accompanying FIGS. 1 to 4.

As shown in FIG. 1, the injection quantity ti is calculated, as described hereinbefore, taking into account a previously established enrichment factor map in accordance with $$ti = tL.Fi.Fba(t) + TVUB$$

where Fba(t) = FBa(o)-DTBAM.t t being zero when the acceleration enrichment is triggered, Fba(t) always being greater than one and Fba(o) being given by FBAM.KFBA.FBA .FBAAM The method by which the adaptive factor FBAAM is established depends upon whether the λ regulator control is active or not, that is upon whether the engine has reached its normal operating temperature or not. If the λ regulator is active, then the engine has warmed up and adaptive acceleration enrichment is based "with λ control" upon the λ regulator value Fr and its comparison with the average value Frm, as described above.

On the other hand, if the λ regulator is not yet active and the engine is therefore still warming up, then provided that the λ probe itself has been heated up sufficiently, adaptive enrichment is made "without λ control" on the basis of the λ probe signal and the presence or absence of engine speed drops during the previous enrichment period. It is of course with the latter warming-up phase that the present invention is primarily concerned and so that operations performed during this phase are described in more detail in the flow diagrams of FIGS. 2 and 3.

Figure 2:
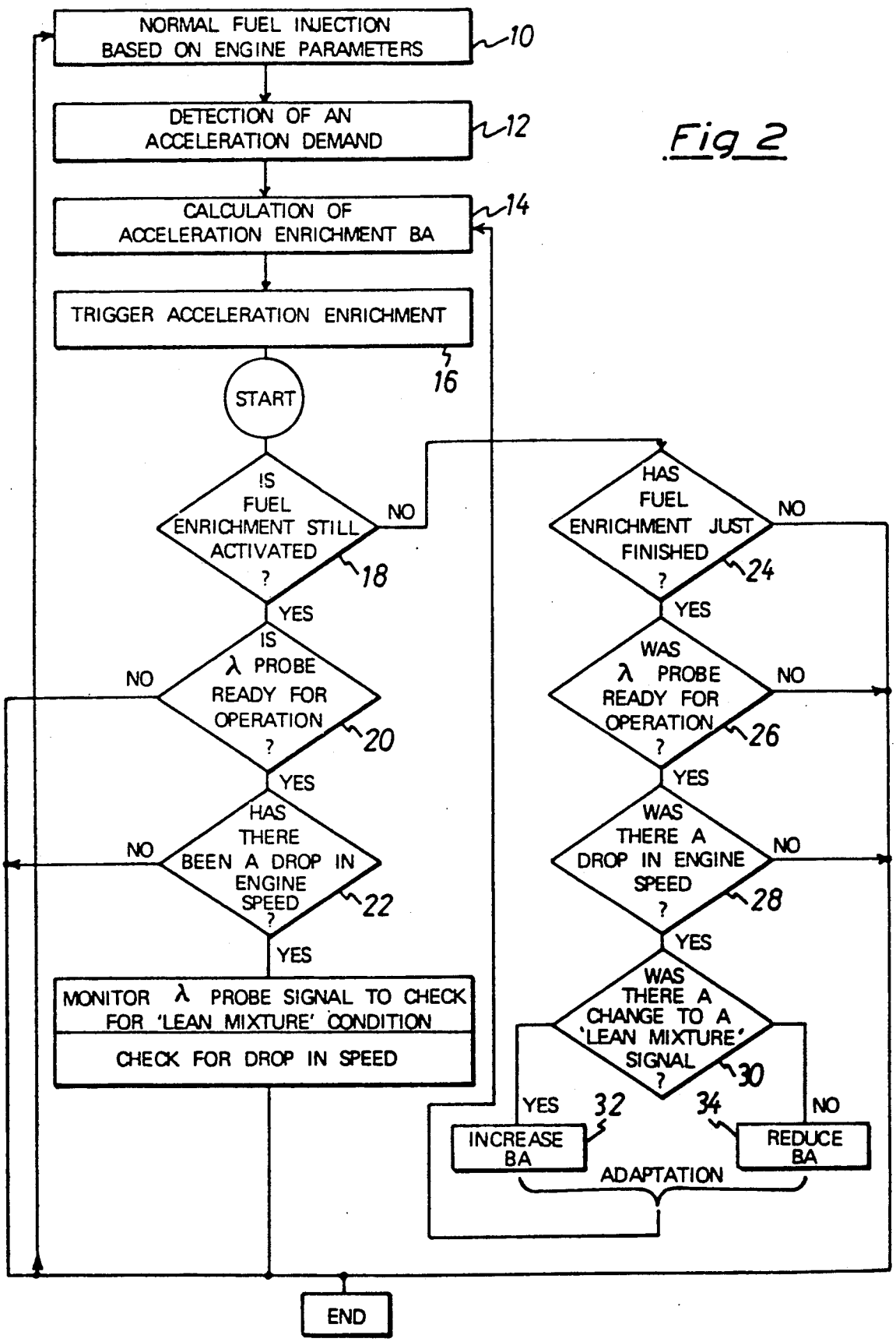
FIG. 2 is a flow diagram illustrating the overall operation of the system when providing adaptive acceleration enrichment without active lambda control.

FIG. 2 illustrates part of a main processing routine which is effective during the warming-up phase of the engine when the λ regulator is not active.

Point 10 indicates the part of the routine where normal fuel injection pulses are generated based on the usual engine parameters such as load t1 and engine speed n. On detection of an acceleration demand at point 12, a routine 14 is activated for the calculation of an acceleration enrichment factor (BA) and acceleration enrichment is triggered at 16.

As explained above, due to the inevitable dealy in the λ probe reacting to a change in the fuel quantity injected, no attempt is made to make any adjustment to the acceleration enrichment factor during a current enrichment process. Rather, what happens during that enrichment is monitored and used after the end of that enrichment step to modify the enrichment factor appropriately for the next enrichment step.

Thus, a decision is made at point 18 as to whether fuel enrichment is still running for that particular acceleration operation. If it is, then a check is made at point 20 to establish whether the λ probe is ready for operation, i.e. is it heated up sufficiently. If it is not, then the routine returns to the beginning 10. If it is, a check is made at 22 as to whether there has been a drop in engine speed during the acceleration enrichment period. If there has not, then the routine returns to the beginning 10. If there has, then the λ probe is monitored to check for any change in its output to the lean mixture condition (λ > 1). Any such change and the speed drop are transferred to RAM within a control computer for future use.

When it is detected at point 24 that a fuel enrichment operation has just finished, checks are made on the stored signals to establish whether the λ probe was ready for operation (point 26) and whether there had been a drop in engine speed during the enrichment operation (point 28). If the answer is positive, it is checked at pint 30 whether there was a change in the λ probe output from a rich (λ < 1) to a lean (λ > 1) during the enrichment operation. If the answer is negative, then it is concluded (point 32) that the enrichment was too great and steps are taken (see FIG. 3) to reduce the adaptation performed at point 14 next time acceleration enrichment is required. On the other hand, if the answer is positive, then it is concluded (point 34) that the enrichment was insufficient and steps are taken to increase the adaptation at point 14 next time.

Figure 3:
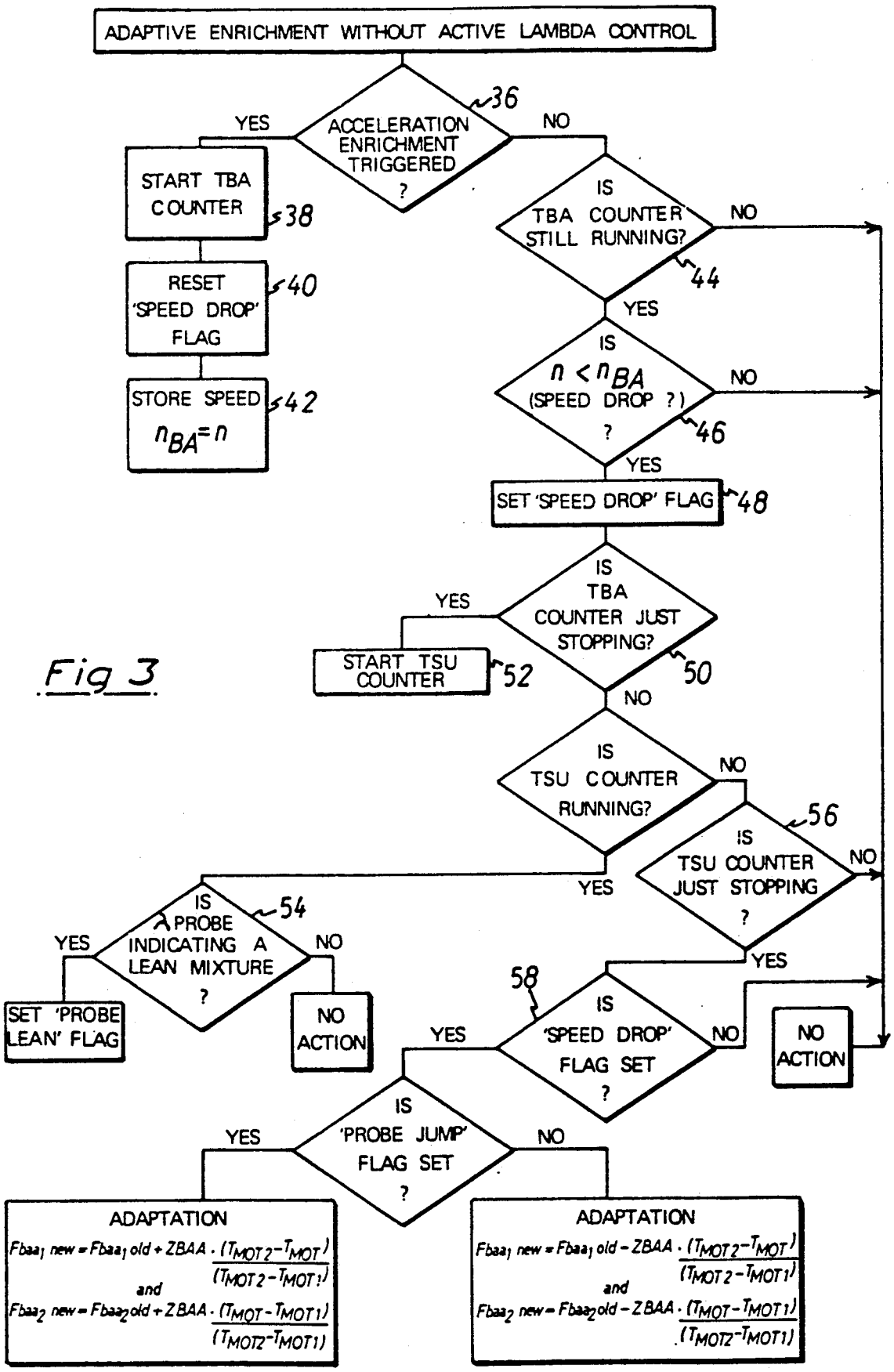
FIG. 3 is a flow diagram showing greater detail of the operation without active lambda control.

Adaptive enrichment without active lambda control is illustrated in more detail in the flow diagram of FIG. 3.

When acceleration enrichment is triggered at point 36, a counter is started (point 38) which counts out the period TBA. The "speed drop" flag is re-set (point 40) in the computer and the current engine speed ($n = n_{BA}$) is recorded (point 42).

During the period that the TBA counter is still running (point 44), a check is made at point 46 as to whether the current engine speed n is less than the recorded speed $n_{BA}$ at the time acceleration enrichment was triggered. If it is less, then the "speed drop" flag is set (point 48). When it is detected at point 50 that the TBA counter had just stopped, then a second counter is started which counts a period TSU (52). While the counter TSU is running, a check is made at point 54 or whether the λ probe is indicating a lean mixture ($\lambda > 1$). If it is, then the "probe lean" flag is set. When it is detected at point 56 that the TSU counter had jut stopped, a check is made at point 58 whether the "speed drop" flat is set. If it is, then it is checked whether the "probe jump" flag was set. If it was, then it is concluded that the acceleration enrichment was too lean during the previous enrichment operation so that the enrichment factor must be increased. A explained above, this is achieved by adjusting the two support points of the FBAAM map upwards in accordance with $$Fbaa1\ \text{new} = Fbaa1\ \text{old} + ZBAA \cdot \frac{(TMOT2 - TMOT)}{(TMOT2 - TMOT1)}$$

and $$Fbaa2\ \text{new} = Fbaa2\ \text{old} + ZBAA \cdot \frac{(TMOT - TMOT1)}{(TMOT2 - TMOT1)}$$

On the other hand, if it is found that the "probe jump" flag has not been set, it is concluded that the acceleration enrichment was too great during the previous enrichment operation so that the enrichment factor must be reduced. This is achieved by adjusting the two support points of the FBAAM map downwards in accordance with:

$$Fbaa1\ \text{new} = Fbaa1\ \text{old} - ZBAA \cdot \frac{(TMOT2 - TMOT1)}{(TMOT2 - TMOT1)}$$

and $$Fbaa2\ \text{new} = Fbaa2\ \text{old} - ZBA \cdot \frac{(TMOT - TMOT1)}{(TMOT2 - TMOT1)}$$

Figure 4:
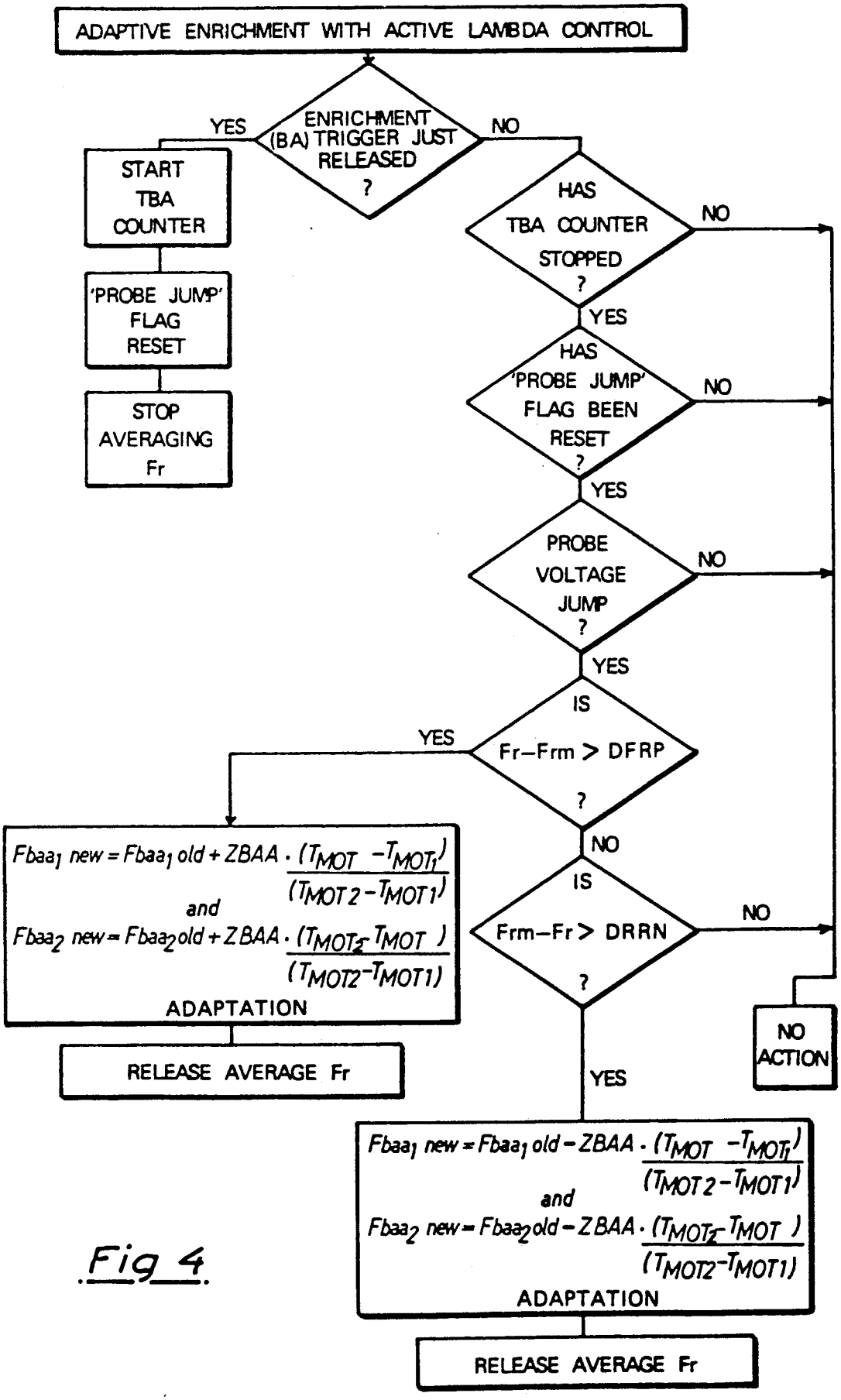
FIG. 4 is a flow diagram illustrating the operation of the system when providing adaptive acceleration enrichment with active lambda control.

FIG. 4 illustrates in more detail a flow chart of the routine which achieves the operation described initially for adaptive enrichment with active lambda control, that is when the engine is fully warmed up. In this case, the decision whether to increase or decrease the acceleration enrichment factor is made on the basis of whether the difference between the current lambda control output Fr and and the stored average value Frm is positive or negative and above predetermined threshold levels DFRP, DRRN, as described above.

Using the above-described techniques, satisfactory adaptive acceleration enrichment (BA) can be maintained during acceleration even when the engine is cold. The conversion rate of the exhaust catalyzer thus remains optimized. Neither is there any deterioration in performance due to varying engine conditions such as, for example, in the event of coking. Extreme coking intake passages reduce charging and hence impair performance to an unacceptable level. Adaptation can also be used in diagnosing such a condition of the engine. The adaptation value for the acceleration enrichment can be read out from non-volatile RAM. If the value is very large, it is likely that the engine valves are badly coked and must be cleaned.

I claim:

1. A fuel injection system for an internal combustion engine, the system having means for controlling a supplying of additional fuel int the inlet manifold of the engine during acceleration conditions to compensate for insufficient transference of vaporized fuel to the engine cylinders during acceleration conditions, with the quantity of additional fuel (BA) being determined by such means in accordance with a stored acceleration enrichment factor value (FBAAM) which is adjusted regularly according to changing engine conditions, with the magnitude and direction of adjustment of the acceleration enrichment factor value (FBAAM) being determined from the behavior of a rotational speed (N) of the engine and a λ probe signal ($\lambda < 1$ or $\lambda > 1$) from a λprobe during an acceleration enrichment operation, and further with the means for controlling the supplying of additional fuel and determining the acceleration enrichment factor value (FBAAM) increasing the amount of additional fuel supplied when a probe signal indicates a lean mixture ($\lambda > 1$) and there was a drop in engine speed.

2. An injection system according to claim 1, wherein the means for controlling the supplying of additional fuel and determining the acceleration enrichment factor value (FBAAM) reduces the amount of additional fuel supplied when the λ probe signal indicates a rich mixture ($\lambda > 1$) and there was a drop in engine speed.

3. An injection system as claimed in claim 2, wherein the system includes means for monitoring during an acceleration enrichment operation changes in the λprobe signal from the probe from a rich mixture signal ($\lambda < 1$) to a lean mixture signal ($\lambda > 1$), and changes in the engine speed, and with the system further including means for storing the monitored λ probe signal values and engine speed changes, and adjusting the stored acceleration enrichment factor value (FBAAM) based on the stored values for use at subsequent acceleration enrichment operations.

4. An injection system as claimed in claim 3, wherein the acceleration enrichment factor value (FBAAM) is in the form of a linear map based upon engine speed according to the expression:

$$\text{FBAAM} = \text{F (TMOT)} \quad (1)$$

the map being established by two support points (FBAA1 and FBAA2) associated with respective engine temperatures (TMOT1 and TMOT2) and increasing the acceleration enrichment factor value (FBAAM), when such acceleration enrichment factor value (FBAAM) is too low by adjusting the support points in accordance with the expressions:

$$FBAA1\ \text{new} = FBAA1\ \text{old} + ZBAA \cdot \frac{(TMOT2 - TMOT)}{(TMOT2 - TMOT1)} \quad (2)$$

and $$FBAA2\ \text{new} = FBAA2\ \text{old} + ZBAA \cdot \frac{(TMOT - TMOT1)}{(TMOT2 - TMOT1)}, \quad (3)$$

wherein,

FBAA1 = first support point

FBAA2 = second support point

ZBAA = adjusting value

TMOT1 = first engine temperature

TMOT2 = second engine temperature and decreasing the acceleration enrichment factor value (FBAAM) when such acceleration enrichment factor value (FBAAM) is too high, by adjusting the support points in accordance with the expressions:

$$FBAA1\ new = FBAA1\ old - ZBAA \cdot \frac{(TMOT2 - TMOT)}{(TMOT2 - TMOT1)} \quad (4)$$

and $$FBAA2\ new = FBAA2\ old - ZBAA \cdot \frac{(TMOT - TMOT1)}{(TMOT2 - TMOT1)} \quad (5)$$

wherein

FBAA1 = first support point

FBAA2 = second support point

ZBAA = adjusting value

TMOT1 = first engine temperature

TMOT2 = second engine temperature.

5. An injection system according to claim 1, the system includes means for detecting when a difference between a current lambda control output (Fr) and a stored average value (Frm) is positive or negative, and above predetermined positive threshold level (DFRP) or below predetermined negative threshold level (DFRN), respectively, and based on the detected values increasing or decreasing the acceleration enrichment factor value (FBAAM).

* * * * *

UNITED STATES PATENT AND TRADEMARK OFFICE

CERTIFICATE OF CORRECTION

PATENT NO. : 5,127,383

DATED : June 7, 1992

INVENTOR(S) : Wild

It is certified that error appears in the above-identified patent and that said Letters Patent is hereby corrected as shown below:

Column 1, line 11, change "during" to --During--.

Column 1, line 13, change "vaporize" to --vaporizes--.

Column 2, line 12, change "0.5" to --5--.

Column 2, line 27, change ".....applying acceleration....." to --.....applying adaptive controls to the injection systsem during acceleration.....--.

Column 2, line 54, change "DRAWING" to --DRAWINGS--.

Column 3, line 6, change "single" to --signal--.

Column 3, line 64, change "λmixture" to ---mixture--.

Column 4, line 67, change "problem" to --probe--.

Column 5, line 1, change "(lean" to --(lean)--.

UNITED STATES PATENT AND TRADEMARK OFFICE

CERTIFICATE OF CORRECTION

PATENT NO. : 5,127,383

DATED : June 7, 1992

INVENTOR(S) : Wild

It is certified that error appears in the above-identified patent and that said Letters Patent is hereby corrected as shown below:

Column 5, line 8, change "<" to -->--.

Column 5, line 43, change "<" to -->--.

Column 5, line 63, change "FBA" to --FBAQ--.

Column 6, line 20, change "t1" to --tL--.

Column 6, line 38, change "." to --?--.

Column 6, line 54, change "pint" to --point--.

Column 7, line 10, change "had" to --has--.

Column 7, line 15, change "jut" to --just--.

Column 7, line 21, change "A" to --As--.

Column 7, line 63 and 64, change "coking intake" to --coking must, however, be removed because the clogged intake--.

UNITED STATES PATENT AND TRADEMARK OFFICE

CERTIFICATE OF CORRECTION

PATENT NO. : 5,127,383

DATED : June 7, 1992

INVENTOR(S) : Wild

It is certified that error appears in the above-identified patent and that said Letters Patent is hereby corrected as shown below:

Column 8, line 6, change "int" to --into--.

Column 8, line 23, change "$\lambda>1$" to --$\lambda<1$--.

Column 8, line 35, change "$\lambda<1$" to --$\lambda>1$--.

Column 8, line 35, change "$\lambda>1$" to --$\lambda<1$--.

Signed and Sealed this

Nineteenth Day of April, 1994

Bruce Lehman

*Attest:*

BRUCE LEHMAN

*Attesting Officer*

*Commissioner of Patents and Trademarks*